US006295659B1

(12) United States Patent
Sandness

(10) Patent No.: US 6,295,659 B1
(45) Date of Patent: Oct. 2, 2001

(54) APPARATUS FOR CLEANING OUT DRAIN PIPE OBSTRUCTIONS

(76) Inventor: Robert C. Sandness, 321 Beaumont St., Las Vegas, NV (US) 89106

( * ) Notice: Subject to any disclaimer, the term of this patent is extended or adjusted under 35 U.S.C. 154(b) by 0 days.

(21) Appl. No.: 09/659,602

(22) Filed: Sep. 11, 2000

Related U.S. Application Data

(63) Continuation-in-part of application No. 09/437,116, filed on Nov. 10, 1999.

(51) Int. Cl.[7] ..... E03C 1/306
(52) U.S. Cl. ..... 4/255.01; 4/255.06; 4/255.09
(58) Field of Search ..... 4/255.01, 255.04–255.11

(56) References Cited

U.S. PATENT DOCUMENTS

| | | | | |
|---|---|---|---|---|
| 1,714,789 | * | 5/1929 | Kolstad | 4/255.04 |
| 1,861,899 | * | 6/1932 | Beach, Jr. | 4/255.04 |
| 2,045,731 | * | 6/1936 | Solari | 4/255.07 |
| 2,086,149 | * | 7/1937 | Allen | 4/255.09 |
| 2,274,453 | * | 2/1942 | Matter | 4/255.04 |
| 3,605,135 | * | 9/1971 | Tan | 4/255.04 |
| 3,644,943 | * | 2/1972 | Parodi Fu Leonardo et al. | 4/255.11 |
| 4,141,090 | * | 2/1979 | Rowan | 4/255.04 |
| 4,756,480 | * | 7/1988 | Fish | 4/255.06 |
| 5,497,514 | * | 3/1996 | Miller | 4/255.04 |
| 5,974,596 | * | 11/1999 | Strzok | 4/255.11 |

FOREIGN PATENT DOCUMENTS

| | | | | |
|---|---|---|---|---|
| 315098 | * | 9/1956 | (CH) | 4/255.05 |
| 2200709 | * | 8/1988 | (GB) | 4/255.04 |

* cited by examiner

*Primary Examiner*—Charles R. Eloshway
(74) *Attorney, Agent, or Firm*—Quirk & Tratos

(57) ABSTRACT

An assembly useful in directing a narrow water stream against an obstruction inside drain plumbing includes an exteriortubular housing within which a spray wand may be telescopically received. A resilient seal is engaged to the free end of the wand, for capture between the tubular housing and the surface around the drain plumbing openings. The other end of the wand is connected across a valve to a source of water at pressure to be ejected through an axial drilling in the free end towards the obstruction. The lateral edge of the tubular housing may include cut-outs to allow manipulation of the valve handle once the valve is secured to the housing.

5 Claims, 2 Drawing Sheets

APPARATUS FOR CLEANING OUT DRAIN PIPE OBSTRUCTIONS

REFERENCE TO RELATED APPLICATION

This application is a continuation-in-part of U.S. patent application Ser. No. 09/437,116 filed Nov. 10, 1999, and entitled Clogged Drain Removal Device.

FIELD OF THE INVENTION

The present invention relates to drain plumbing clean out devices and more particularly to water stream producing structures conformed to direct the stream towards a drain pipe obstruction.

DESCRIPTION OF THE PRIOR ART

In a household obstruction of a sink drain pipe or other drain plumbing occurs with some regularity. Typically the obstruction is in the first convolution of the plumbing trap, and it is at this level that most of the households resort to some self-help or do-it-yourself procedures.

In the past various devices have been developed that in one way or another assist the homeowner in his or her obstruction cleaning efforts. Amongst these are various plungers, flexible augers and even chemical aids that are now widely found in a household, each providing one or another advantage. Since most plumbing obstructions occur in drain plumbing that is proximate a fresh water supply at pressure, there has also been some development of drain clearing structures that rely on this high pressure flow.

Examples of such devices are shown in U.S. Pat. No. 3,605,135 to Tan; U.S. Pat. No. 5,524,296 to Leighton, U.S. Pat. No. 3,109,178 to Bailey; and U.S. Pat. 5,261,128 to Davenport, each describing one or another form of a water pressure plunger. While suitable for the purposes intended, the foregoing devices each rely on producing static water pressure behind the obstruction to clear the drain. With some frequency, however, this static water pressure acts to compact the obstruction even further, resulting in a drain that remains plugged up while producing unpleasant back flow and back spray.

To resolve these events, there have also been devised in the past structures which attempt to direct a focused water stream at the obstruction. Included amongst these are those described in U.S. Pat. No. 4,756,480 to Fish; U.S. Pat. No. 5,497,514 to Miller; and U.K. Patent 2,200,709 to Thompson. While suitable for the purposes intended, each of the foregoing describe one form or another of a high pressure stream structure that is either insertable into the drain or fitted into a gasket or seal at the drain opening but not movable relative thereto.

A structure that effects a seal at the drain opening while being also movable relative the obstruction is therefore extensively sought, and it is one such structure that is disclosed herein.

SUMMARY OF THE INVENTION

Accordingly, it is the general purpose and object of the present invention to provide a drain obstruction clearing assembly in which a high-pressure water stream can be directed across a seal towards the obstruction.

Other objects of the present invention are to provide a water stream directing structure sealed at the drain opening.

Yet further objects of the invention are to provide a drain clearing assembly that is convenient in use and in fabrication.

Briefly, these and other objects are accomplished within the present invention by providing an elongate tubular extension connected at one end to a ball valve receiving water at pressure from a hose and including an end fitting at the other end that is axially pierced to produce a narrow exit stream. The extension is passed through an elastomeric circular gasket or seal, of a platform greater than a drain opening, useful to contain any back flow once the extension is aligned on the drain to direct the stream towards the obstruction. A tubular housing, open at both ends, surrounds the extension in the course of its use and is useful to compress by one end the gasket against the surfaces adjacent the drain opening. The housing may further include lateral cutouts at the other end to allow pivotal translation of the valve operating handle.

Preferably the extension is shorter than the housing allowing for sliding manipulation through the seal that is captured by a retaining washer between the housing and the drain opening, providing for a dished recess above the drain. The high pressure, narrow focus, water stream emerging from this dished recess is then useful to fraction the obstruction and then wash it away.

DESCRIPTION OF THE PREFERRED EMBODIMENT

Figure 1:
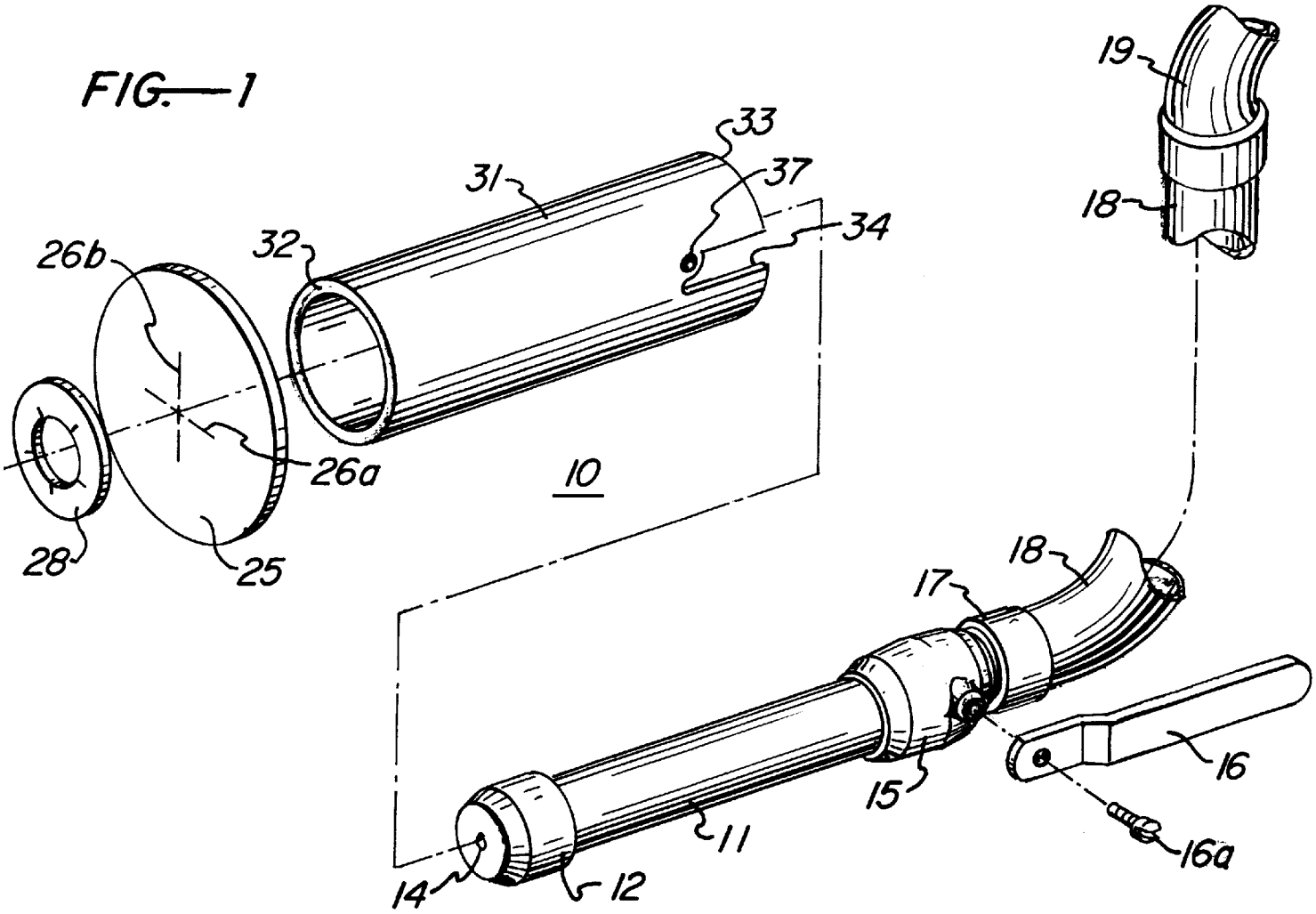
FIG. 1 is a perspective illustration, separated by parts, of the inventive drain clean-out assembly.
Figure 2:
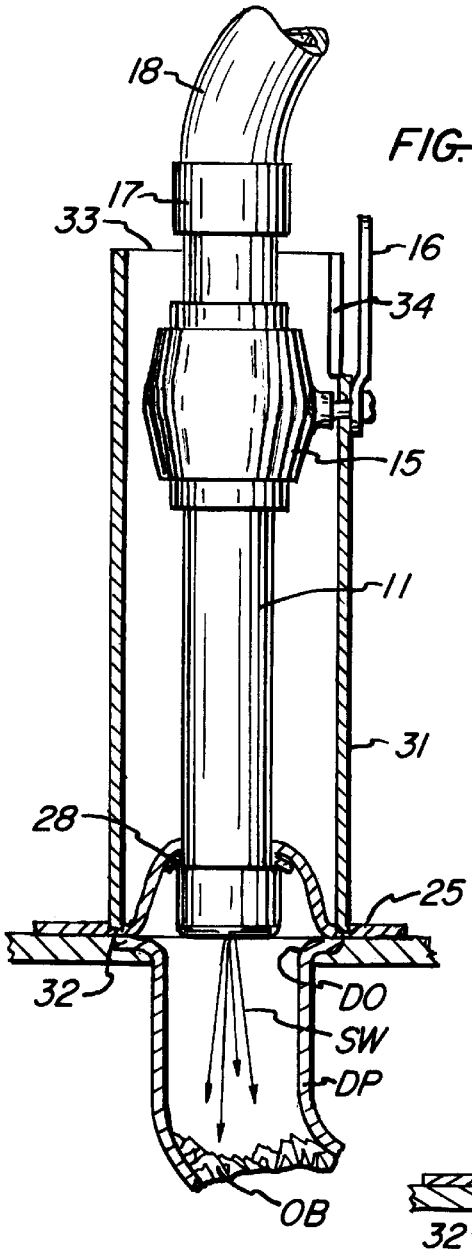
FIG. 2 is a sectional side view of the inventive drain clean-out assembly aligned for use adjacent an obstruction.
Figure 3:
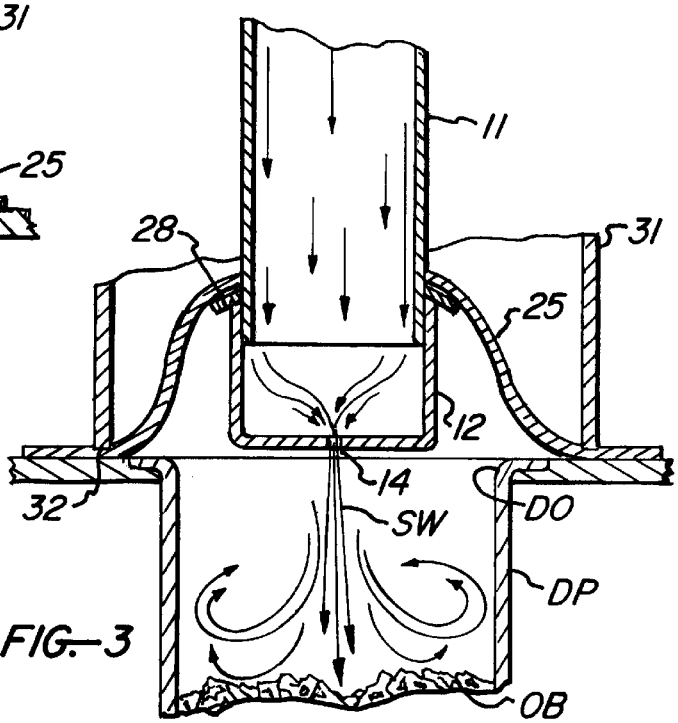
FIG. 3 is a sectional view of an end opening aligned for developing a narrow, focused rooter stream against said obstruction.

As shown in FIGS. 1–3, the inventive clean-out assembly generally designated by the numeral 10 comprises a length of a pipe 11 fitted at the end with an end cap 12 and mated at the other end to a valve assembly 15. Valve 15, in a manner well known in the art, includes a handle 16 for controlling the flow through the valve, handle 16 pivotally aligning along the valve flow axis when fully open and transversely to the flow when closed. The opposite, input opening of the valve then mates to a hose adapter 17 connected to one end of a flexible water hose 18 which at the other end is fitted to any fresh water outlet 19. The water flow through the valve is then converged through a narrow opening 14 in the end cap 12, to form a narrow, focused high-velocity stream SW.

In this form pipe 11 forms an extension at the end of hose 18 which may be inserted towards a drain opening DO towards an obstruction OB in the drain plumbing or trap DP. The high velocity stream SW then impinges onto the obstruction matter OB, separating any agglomeration so that it can pass down the drain plumbing. Of course, until the drain is opened the water flow collects as back flow with frequent splashing and spray.

To limit this back flow and back spray, a circular gasket 25 is provided, made of an elastomeric or rubber material structure and dimensional to a circular platform greater than the drain opening DO. At the center of its platform gasket 25 includes two orthogonal slits 26*a* and 26*b* which allow, by elastic expansion, the insertion of pipe 11 therethrough. Once inserted, pipe 11 is then retained by a speed nut 28 threaded over cap 12.

The assembly, including pipe 11, moreover, may be received in the interior of a tubular segment 31 of a sectional dimension larger than the drain opening DO and smaller than the platform dimension gasket 25. The lower end 32 of segment 31 is then useful to compress the gasket against the surfaces adjacent the drain opening.

The other end 33 of segment 31 may include a lateral cutout 34 accommodating the laterally protruding handle 16 in its pivotal motion to regulate the flow through pipe 11.

To fix the geometric relationship between pipe 11 and segment 31, a lateral drilling 37 is formed in the wall of segment 31, adjacent cutout 34, through which a fastener 16*a* attaching handle 16 to valve 15 can be passed. In this manner the valve handle attachment fixes the insertion geometry of the assembly which, because of the pipe length captured by speed nut 28 in the elastically expanding slits 16*a* and 16*b*, earlier described forms a dished recess or concavity in the seal face. Manual force applied to the exterior of the housing segment 31 will then force the gasket into sealing engagement while valve 15 is being opened by the articulation of handle 16.

In this manner the water jet developed at the opening 14 can be used to dislodge any obstruction in an assembly that is conveniently connected to any available water source 19, shown as a wall faucet. The combination of the water pressure and the dynamic impingement of the water stream effectively clears most stubborn drains.

Obviously, many modifications and variations can be effected without departing from the spirit of the present invention. It is therefore intended that the scope of the invention be determined solely by the claims appended hereto.

I claim:

1. Apparatus useful in clearing obstructions in drain plumbing having a drain opening positioned proximate a source of water at pressure, comprising:

a tubular housing defined by a first and a second end each of a sectional dimension greater than said drain opening;

a pipe segment conformed for axial receipt in said housing and provided with an axial drilling at one end thereof and a pipe fitting at the other end;

a valve connected to said pipe fitting and adapted to communicate with said source of water for controlling the flow of said water through said pipe segment and said axial drilling, said valve being provided with a handle on the lateral exterior thereof adapted to be secured to said valve by a threaded securing device;

said second end of said housing includes a lateral cut-out conformed to receive said handle;

said housing is provided with a lateral opening conformed to pass said threaded securing device between said handle on the exterior of said housing to said valve on the interior of said housing; and a generally planar seal formed of a resilient material structure provided with an opening conformed for resilient expansion to receive said pipe segment extending distal of said first end of said housing, whereby manual compression of said first end against said seal in alignment over said drain opening provides a closure of said opening.

2. Apparatus according to claim 1 wherein:

said axial drilling is conformed to produce a stream of said water.

3. Apparatus according to claim 1 wherein:

said seal is of a planform greater than said first end.

4. Apparatus for clearing obstructions in drain plumbing provided with a drain opening, comprising:

a tubular housing defined by a first end and a second end cooperatively forming a common axial interior cavity;

a source of water at pressure;

a water spray assembly flexibly connected at one end to communicate with said source of water and including a pipe segment telescopically receivable in said cavity at the free end, the free end of said pipe segment including an axial drilling for ejecting a stream of said water;

an elastic seal resiliently engaged to said pipe segment adjacent said first end of said housing for compressed capture between said housing and said drain opening a valve connected between said pipe segment and said flexible connection with said water source, said valve including a handle on the lateral exterior thereof; and said second end of said housing includes a lateral cut-out conformed to receive said handle.

5. Apparatus according to claim 4 wherein:

said handle is adapted to be secured by a threaded securing device to said valve; and said housing is provided with a lateral opening conformed to pass said threaded securing device between said handle on the exterior of said housing to said valve on the interior of said housing.

* * * * *